US008528625B2

(12) United States Patent
Augustin et al.

(10) Patent No.: US 8,528,625 B2
(45) Date of Patent: Sep. 10, 2013

(54) CASING MOLDED WITH ATTACHED PIPES

(75) Inventors: Remi Augustin, Sartrouville (FR); Gerard Dedieu, Saint Gratien (FR); Christian Henri Paul Mauhe, Sartrouville (FR)

(73) Assignee: Hispano Suiza, Colombes (FR)

( * ) Notice: Subject to any disclaimer, the term of this patent is extended or adjusted under 35 U.S.C. 154(b) by 0 days.

(21) Appl. No.: 13/256,687

(22) PCT Filed: Mar. 16, 2010

(86) PCT No.: PCT/EP2010/053335

§ 371 (c)(1), (2), (4) Date: Sep. 15, 2011

(87) PCT Pub. No.: WO2010/106043

PCT Pub. Date: Sep. 23, 2010

(65) Prior Publication Data

US 2012/0003494 A1 Jan. 5, 2012

(30) Foreign Application Priority Data

Mar. 17, 2009 (FR) ..... 09 51701

(51) Int. Cl.

| | |
|---|---|
| ***B22D 19/00*** | (2006.01) |
| ***B22D 19/04*** | (2006.01) |
| ***B22D 19/16*** | (2006.01) |

(52) U.S. Cl.

USPC ..... 164/98; 164/100; 164/112

(58) Field of Classification Search

USPC ..... 164/6, 91, 98, 100, 101, 112, 75

See application file for complete search history.

(56) References Cited

U.S. PATENT DOCUMENTS 4,450,886 A 5/1984 Enomoto et al.

FOREIGN PATENT DOCUMENTS

| | | |
|---|---|---|
| DE | 38 37 254 | 5/1990 |
| DE | 103 04 971 | 6/2004 |
| EP | 2 008 740 | 12/2008 |
| JP | 58 217671 | 12/1983 |

OTHER PUBLICATIONS

International Search Report issued Apr. 28, 2010 in PCT/EP10/053335 filed Mar. 16, 2010.

*Primary Examiner* — Kevin P Kerns

(74) *Attorney, Agent, or Firm* — Oblon, Spivak, McClelland, Maier & Neustadt, L.L.P.

(57) ABSTRACT

A method for making a light alloy foundry part that includes at least one piping supported by a wall of the part. The method includes making the piping, making a mold reproducing a shape of the part without the piping, positioning the piping in the mold, and casting a metal for making the part. At least a portion of the piping is subjected, prior to the installation thereof in the mold, to a surface-processing to generate a thermal barrier between the portion of the piping and the casting metal, the mold including at least one hollow location around the piping for making a bridge for supporting the piping and extending from the wall of the foundry part.

5 Claims, 3 Drawing Sheets

Section I - I

Section I - I

Section II - II

CASING MOLDED WITH ATTACHED PIPES

FIELD OF THE DISCLOSURE

The field of the present invention is that of the manufacture of components by casting, and more particularly that of molded components, made of aluminum or one of its alloys, which comprise integrated ducts. These ducts have the general purpose of guiding a lubricant or gaseous fluid to the parts inside this component. The present invention can be applied most particularly to the manufacture of components such as cylinder heads or casings, such as gearbox casings for aero engines.

BACKGROUND

It is particularly difficult to cast casings made of light alloy, that is to say of an aluminum- or magnesium-based alloy, and containing pipes made of a similar alloy. Techniques commonly used consist either in casting the pipe at the same time as the casing or in integrating a pipe into the mold prior to casting, but ensuring that said pipe is not damaged by the molten metal.

In the first case, a mold is produced, said mold forming a cavity, for example by means of a sand core, corresponding to the pipe to be produced; this technique has the advantage that the pipe can be produced from the same alloy as the casing and thus subsequent expansions of the casing are dealt with and so the occurrence of stresses which would arise on account of the use of different materials is avoided. The casing mold is manufactured by fitting sand cores, which reproduce the interior of the pipe to be manufactured and which are positioned at the location at which this pipe is intended to appear. The drawback of this technique is that it is necessary to check the pipes after casting in order to ensure that the sand has been removed properly at the end of the operation and that there are no longer any grains, which could detach during operation and could cause faults in the operation of the mechanisms fitted inside the casing. This verification, in conjunction with possible alterations, is a long and expensive operation which it is desirable to eliminate. Further drawbacks are also encountered, such as creeping of the sand cores, which creates imprecision in the positioning of the outlets of the lines, such as variations in thickness along the pipes, or even such as the possible presence of voids at the intersections of the sand cores. Furthermore, the tubes produced directly during casting have greater thicknesses than conventional pipes which are produced independently. The overall mass of the casing is prejudiced even more, it being possible for the increase in mass to reach 10% of the blank, in other words of the casing straight after casting, before it is machined to the final dimensions.

Another method of manufacturing a casing made of light alloy is described in European patent application EP 0470021 from Montupet S. A. In this case, the pipes are produced independently of the casing and then integrated into the latter before the alloy is cast. However, this technique requires that a large number of precautions be taken, such as, for example, selecting the alloy of the pipe such that its melting point is higher than that of the alloy to be melted and/or providing that a cooling fluid flows through the pipe during casting. In addition, there must be a, very short, period of contact between the tubes and the molten metal.

Also known is document U.S. Pat. No. 4,450,886, which relates to a method of producing intake pipes in the automotive field, into which pipes an exhaust gas recirculation tube is integrated. This document does not mention in particular how the recirculation tube is held during the casting of the metal of the intake tube.

SUMMARY

The aim of the present invention is to remedy these drawbacks by providing a method for producing a casing made of light alloy which does not have some of the drawbacks of the prior art and which, in particular, leads to a casing which is optimized in terms of mass devoted to the production of its internal pipes.

To this end, the subject of the invention is a method for producing a light alloy casting including at least one pipe that is supported by a wall of said casting, said method comprising the steps of producing said pipe, producing a mold which reproduces the form of said casting without said pipe, positioning said pipe in said mold and casting metal in order to produce said casting, characterized in that, before the pipe is fitted in the mold, at least a part thereof is subjected to a surface treatment step intended to generate a thermal barrier between this part of said pipe and the casting metal, said mold comprising at least one hollowed-out region around the pipe so as to produce a bridge that holds the pipe and extends from said wall of the casting.

The creation of a thermal barrier avoids having to provide on the pipes any overthicknesses, which would be made necessary in order to withstand the risks of alteration during contact with the casting metal of the casing. Moreover, the use of bridges makes it possible to reduce the mass of the casing devoted to holding the pipes: this method of holding by means of discretely positioned elements leads to a much lighter casing than if the pipes were overmolded along their entire length. The casing can thus be designed with a minimum mass.

Preferentially, the surface treatment is anodic oxidation. Such a treatment is commonly implemented in the manufacture of components made of light alloy and is thus easy to carry out.

In one particular embodiment, said mold comprises at least one hollowed-out region around said pipe so as to produce a bridge that holds the pipe and extends from said wall of the casting.

In this particular embodiment, all of that part of the pipe that is intended to be embedded in a bridge is subjected to said prior surface treatment step.

In one particular embodiment, when at least one pipe passes through a wall, said pipe is overmolded with regard to its part outside said casting. This thus avoids the problems of sealing at the point at which it passes through the wall.

The invention also relates to a casting produced by one of the above-described methods, in which the pipe is produced substantially from the same alloy as the casting.

The melting points of the casing and of the pipe are thus close to one another and the risks of the pipe being damaged during casting are reduced.

The invention also relates to a casing including a light alloy casting produced by an above-described method and also to a casing in which the pipe is produced substantially from the same alloy as the casting.

Finally, it also relates to a gearbox including a casing as described above and to an aero engine including such a gearbox.

The invention will be understood better, and further aims, details, features and advantages thereof will become more clearly apparent from the following detailed explanatory description of an embodiment of the invention which is given purely by way of illustrative and nonlimiting example with reference to the appended schematic drawings.

DETAILED DESCRIPTION OF THE EMBODIMENTS

Figure 1:
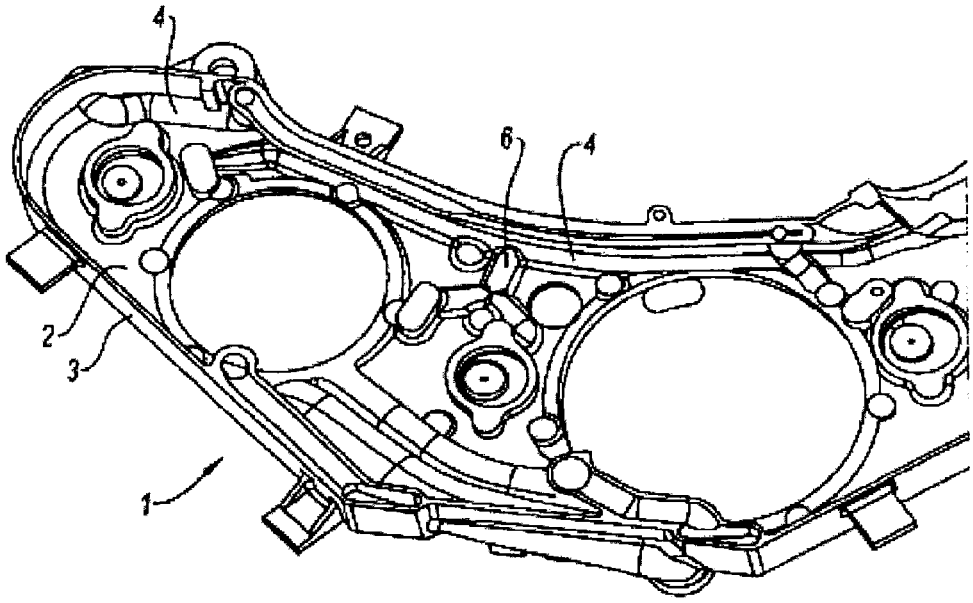
Fig. 1 PRIOR ART
FIG. 1 is a perspective view of half of a molded casing of the prior art, in which the pipes are integrated into the casing.

Reference is made to FIG. 1, which shows half of a gearbox casing 1 according to the prior art for an aero engine. This casing is a casting made of light alloy. The casing 1 has an elongate and curved form, similar to that of a banana, in order to match the circular form of the engine in which it is mounted. It forms a box intended to hold gears. The casing has two approximately planar end walls 2 and a peripheral wall 3, which is closed on itself and extends perpendicularly to the end wall. The end walls 2 are pierced by holes in order to let through the shafts driven by pinions (not shown) of the gearbox. Along the end walls 2 of the gearbox there run pipes 4, the function of which is to transport a fluid, such as oil, for lubrication and recovering heat generated by the gears.

Figure 2:
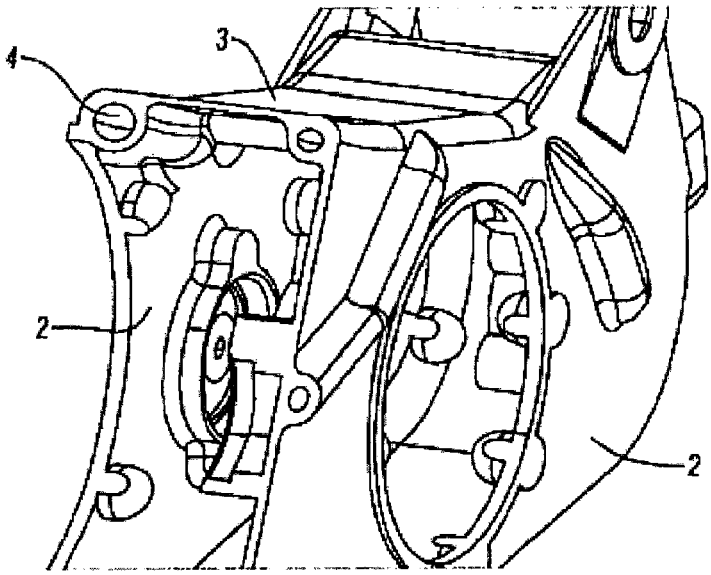
Fig. 2 PRIOR ART
FIG. 2 is a perspective view of a cross section through the same prior art casing, FIG. 3(*a*) is a perspective view of half of a molded casing according to one embodiment of the invention, in which the pipes are attached before the casting operation, FIG. 3(*b*) is a sectional view taken along a line I-I shown in FIG. 3(*a*) showing a bridge formed around a pipe, FIG. 3(*b*) is a sectional view taken along a line II-II shown in FIG. 3(*a*) showing a gap between a pipe and a wall.

Reference is made to FIG. 2, which shows a pipe 4 running along the angle formed by the end wall 2 and the peripheral wall 3 of a casing 1 of the prior art. This pipe 4 is produced in one piece with the end wall 2 and the peripheral wall 3 by being cast directly with the two corresponding walls, and forms a single body with them.

Figure 3A:
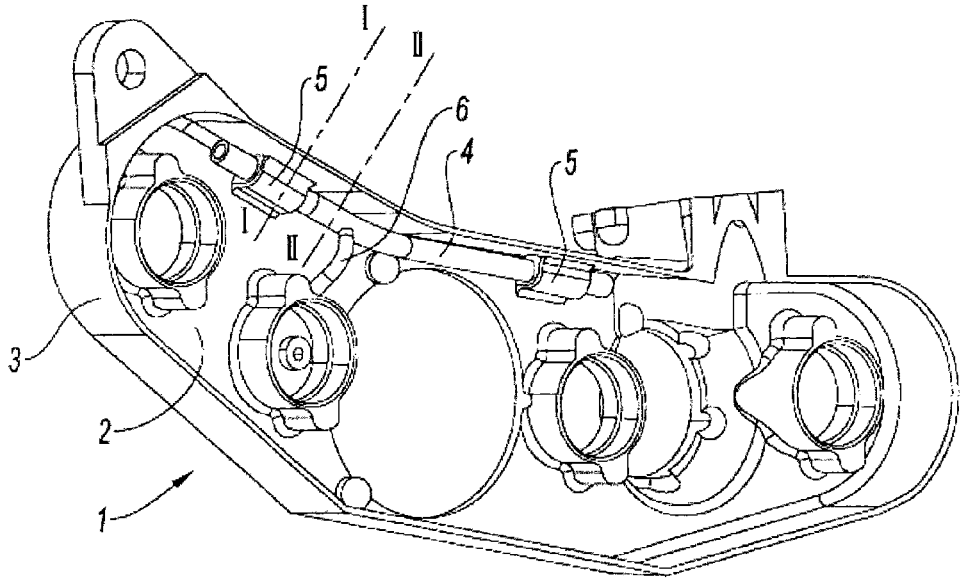
Figure 3B:
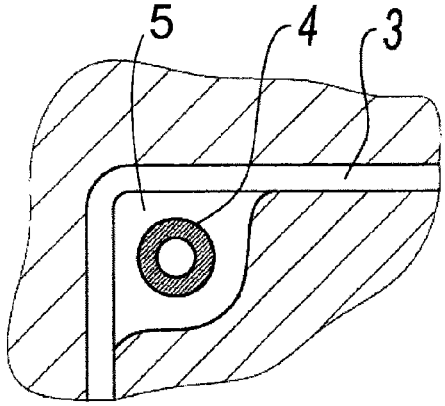
Figure 3C:
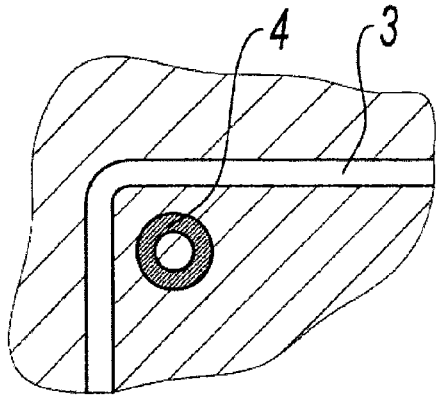

Reference is now made to FIGS. 3(*a*), 3(*b*), and 3(*c*). FIG. 3(*a*) shows a casing 1 in which the pipes 4 are separate from the walls 2 and 3 of the casing 1, to which they are attached by bridges 5 which are for their part cast in one piece with the walls of the casing 1. The pipes 4 consist of the same alloy as the casing 1 but are produced before this casing is cast. FIG. 3(*b*) is a sectional view taken along a line I-I shown in FIG. 3(*a*), which shows the bridge 5 formed around the pipe 4. FIG. 3(*c*) is a sectional view taken along a line II-II shown in FIG. 3(*a*), which shows a gap between the pipe 4 and the wall 3 of the casing 1.

Figure 4:
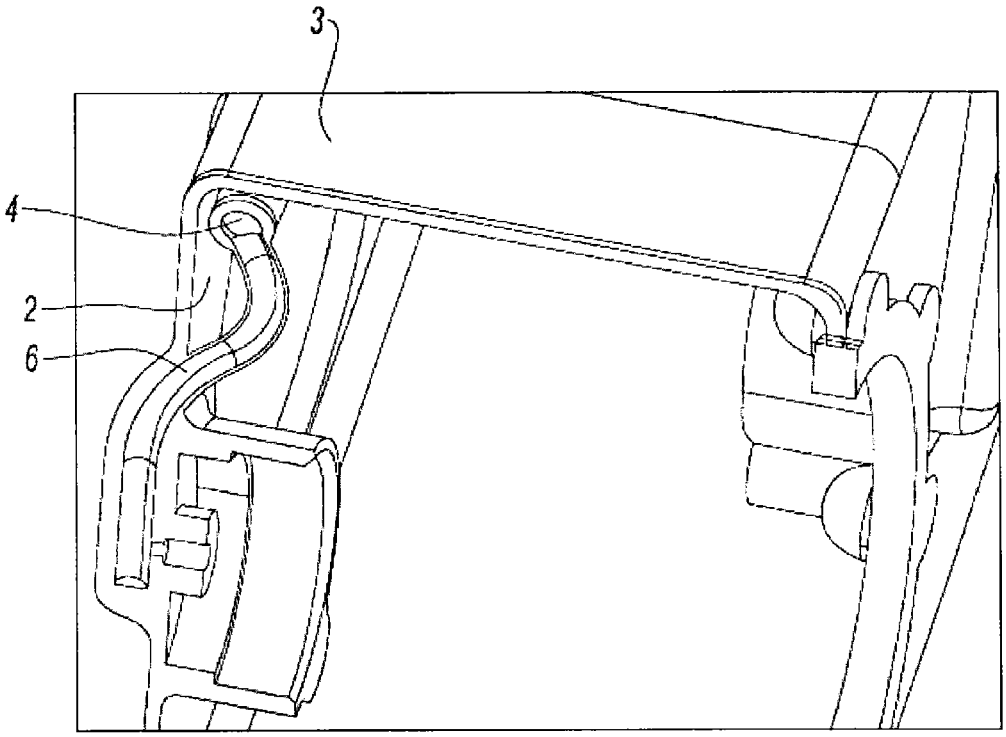
FIG. 4 is a perspective view of a cross section through a molded casing according to one embodiment of the invention.

Reference is made to FIG. 4, which shows a pipe 4 housed inside the casing 1, a shunt pipe 6 leading away from said pipe 4 to supply a particular gear. This shunt pipe 6 differs from the other pipes 4 in that it passes through one of the walls 2 of the casing 1. The production of this type of pipe represented a particular problem in the prior art, since it was necessary to precisely position the core representing this future pipe in the casing mold. Fitting the actual pipe in the mold before the metal is cast and overmolding it with the casting ensures that the exit point of this line is perfectly positioned and thus avoids the risks of rejection of casings in which the exit point has not been positioned correctly.

FIG. 4 shows a pipe 4 which passes through one of the end walls 2 of the casing and then runs around the outside of the casing. However, oil mist fills the inside of the casing. All of that part of the pipe which is located outside the casing is overmolded such that there is no break in the seal between the inside and the outside of the casing at the point where the pipe passes through the wall.

The casing 1 according to the invention is thus produced in the following manner:

The pipes 4 intended to be introduced into the casing 1 are cast in advance by a conventional manufacturing method. They are preferably produced from the same alloy as is selected to produce the casing in order to avoid the problems of different expansions which would occur if materials having different compositions were selected. However, they can be produced from an alloy similar to that provided for casting, as long as the melting points of these two components are not too far apart from one another.

In order to carry out the casting and ensure that the pipes are not damaged by contact with the molten metal, the invention proposes protecting the pipes with a thermal barrier around their outer perimeter. For this purpose, the pipes are subjected, before they are installed in the casting mold, to a surface treatment, such as anodic oxidation, which creates a surface oxide layer. Any other surface treatment that leads to the creation of a thermal barrier is likewise conceivable.

By virtue of this surface treatment, their diameter and their thickness are defined in a manner depending on the stresses that they must be subjected to during use, without taking into account any overthicknesses which would be made necessary in order to withstand the risks of alteration during contact with the casting metal of the casing. The casing can thus be designed with a minimum mass as far as these elements are concerned.

A mold is produced, again in a conventional manner, corresponding to the form desired for the casing after molding; this form is defined a priori without taking the pipes 4 into account.

The latter are then fitted inside the mold before the casting and are positioned at their final position, in relation to the position of the future walls of the casing, by conventional techniques known to a person skilled in the art. Hollowed-out regions are formed in the mold, surrounding the pipes 4 in a spaced-apart manner such that bridges 5 are formed around these pipes and hold them once casting has been carried out.

The casing is finally produced by casting the metal of which it is made. The pipes 4 are from then on fixed to the walls of the casing by the bridges 5 which are formed during the cooling of the casting metal.

In one particular embodiment, the pipes 4 are only subjected to conventional anodic oxidation (or to any other surface treatment which would create a thermal barrier on their outer part) at their portions which will be enclosed by bridges 5. The rest of the pipes will consequently be subjected to the surface treatment which is applied to the whole of the casing.

Although the invention has been described in conjunction with a particular embodiment, it is quite clear that it encompasses all technical equivalents of the means described and combinations thereof where these fall within the scope of the invention.

The invention claimed is:

1. A method for producing a light alloy casting including at least one pipe that is supported by a wall of the casting, the method comprising:

obtaining the at least one pipe;

obtaining a mold that reproduces a form of the casting without the at least one pipe, the mold including at least one hollowed-out region which corresponds to a respective bridge to be formed around the at least one pipe that holds the at least one pipe and extends from the wall of the casting when the casting is complete;

having a portion of the at least one pipe to be surrounded by the respective bridge subjected to a surface treatment to generate a thermal barrier between the portion of the at least one pipe and casting metal;

positioning the at least one pipe in the mold, the at least one pipe being spaced apart from the wall of the casting to be formed when the casting is complete; and pouring the casting metal into the mold to produce the casting, the at least one pipe being fixedly connected to the wall of the casting via the respective bridge when the casting metal cools down.

2. The method for producing a casting as claimed in claim 1, in which the surface treatment includes anodic oxidation.

3. The method for producing a casting as claimed in claim 1, in which all of the portion of the at least one pipe that is to be embedded in the respective bridge is subjected to the surface treatment.

4. The method for producing a casting as claimed in claim 1, in which the at least one pipe passes through a wall, and the at least one pipe is overmolded with regard to its part outside the casting.

5. The method for producing a casting as claimed in claim 1, in which only a portion of the at least one pipe to be surrounded by the respective bridge is subjected to a surface treatment.

* * * * *